US009272428B2

(12) United States Patent
Müller et al.

(10) Patent No.: US 9,272,428 B2
(45) Date of Patent: Mar. 1, 2016

(54) METHOD, DEVICE AND MEASURING DEVICE FOR CUTTING OPEN FOODSTUFF

(71) Applicant: CFS BÜHL GMBH, Kempten (DE)

(72) Inventors: Ralf-Peter Müller, Kempten (DE); Jörg Schmeiser, Wiggensbach (DE)

(73) Assignee: GEA FOOD SOLUTIONS GERMANY GMBH, Kempten (DE)

( * ) Notice: Subject to any disclaimer, the term of this patent is extended or adjusted under 35 U.S.C. 154(b) by 0 days.

(21) Appl. No.: 14/041,123

(22) Filed: Sep. 30, 2013

(65) Prior Publication Data

US 2014/0090535 A1 Apr. 3, 2014

Related U.S. Application Data

(62) Division of application No. 12/988,027, filed as application No. PCT/EP2009/002828 on Apr. 17, 2009.

(30) Foreign Application Priority Data

Apr. 18, 2008 (DE) ..... 10 2008 019 776

(51) Int. Cl.
*B26D 1/00* (2006.01)
*B26D 5/00* (2006.01)
(Continued)

(52) U.S. Cl.
CPC ..... *B26D 1/0006* (2013.01); *B26D 5/007* (2013.01); *B26D 7/00* (2013.01); *B26D 7/0006* (2013.01);
(Continued)

(58) Field of Classification Search
CPC .. B26D 2210/02; B26D 7/2621; B26D 1/006; B26D 2001/006; B26D 2001/0053
USPC ..... 83/676, 703–731, 409–409.2, 734, 932, 83/403.1, 206, 73.1, 76.7, 76.8, 360–372, 83/350–357, 62, 62.1; 30/347
See application file for complete search history.

(56) References Cited

U.S. PATENT DOCUMENTS 1,957,623 A * 5/1934 Walter ..... 83/88
1,973,526 A * 9/1934 Diamond et al. ..... 83/310
(Continued)

FOREIGN PATENT DOCUMENTS

AT 326514 6/2006
DE 2306822 A1 8/1974
(Continued)

OTHER PUBLICATIONS

DE4429046 tranlation; Feb. 22, 1996; Horst Heinze.*
(Continued)

*Primary Examiner* — Laura M Lee
(74) *Attorney, Agent, or Firm* — The Dobrusin Law Firm, P.C.

(57) ABSTRACT

New methods, devices and measuring devices for slicing food are required for solving problems that occur with existing methods and devices and/or for reacting to changes to the food product being sliced. The devices include a blade for slicing food comprising a blade edge and a recess. The recess has a center point and may be employed for mounting and centering the blade on a slicing device. At least one dimension, D, of the recess is a length or diameter of the recess and preferably is at least 140 mm and at most 450 mm. The blade edge preferably has a radius, R, measured from the blade edge to the center point of the recess. The ratio of R/D preferably is less than 2.0 for every point on the blade edge.

7 Claims, 3 Drawing Sheets

(51) Int. Cl.

| | |
|---|---|
| ***B26D 7/00*** | (2006.01) |
| ***B26D 7/08*** | (2006.01) |
| ***B26D 7/26*** | (2006.01) |
| *B26D 5/32* | (2006.01) |
| *B26D 5/34* | (2006.01) |
| *B26D 7/06* | (2006.01) |
| *B26D 7/12* | (2006.01) |
| *B26D 7/30* | (2006.01) |

(52) U.S. Cl.

CPC ..... *B26D 7/08* (2013.01); *B26D 7/2628* (2013.01); *B26D 7/2635* (2013.01); *B26D 5/32* (2013.01); *B26D 5/34* (2013.01); *B26D 7/0625* (2013.01); *B26D 7/12* (2013.01); *B26D 7/30* (2013.01); *B26D 2210/02* (2013.01); *B26D 2210/08* (2013.01); *Y10T 83/0448* (2015.04); *Y10T 83/929* (2015.04)

(56) References Cited

U.S. PATENT DOCUMENTS

| | | | | |
|---|---|---|---|---|
| 2,472,876 | A * | 6/1949 | Ahrndt et al. | 83/676 |
| 3,299,925 | A * | 1/1967 | McBrady et al. | 83/676 |
| 3,491,818 | A | 1/1970 | Schaller | |
| 3,897,020 | A * | 7/1975 | Knecht | 241/292.1 |
| 3,969,966 | A * | 7/1976 | Dillon | 83/340 |
| 4,015,494 | A | 4/1977 | Spooner et al. | |
| 4,043,238 | A * | 8/1977 | van Ham | 83/595 |
| 4,625,782 | A * | 12/1986 | Jameson | 144/193.1 |
| 5,065,656 | A * | 11/1991 | Flisram | 83/356.3 |
| 5,628,237 | A | 5/1997 | Lindee | |
| 5,787,776 | A | 8/1998 | Nishimoto | |
| 5,988,033 | A * | 11/1999 | Skaar et al. | 83/596 |
| 5,989,116 | A | 11/1999 | Johnson et al. | |
| 5,996,917 | A * | 12/1999 | Ehrle et al. | 241/292.1 |
| 6,386,469 | B1 | 5/2002 | Meister et al. | |
| 6,427,572 | B2 | 8/2002 | Ciani et al. | |
| 6,935,215 | B2 | 8/2005 | Lindee et al. | |
| 7,614,574 | B2 | 11/2009 | Jakobi et al. | |
| 7,856,913 | B2 * | 12/2010 | Matzunsky et al. | 83/676 |
| 8,424,436 | B2 * | 4/2013 | Weber | 83/676 |
| 2004/0211302 | A1 | 10/2004 | Weber | |
| 2007/0028742 | A1 | 2/2007 | Mueller et al. | |
| 2007/0214969 | A1 | 9/2007 | Mueller et al. | |
| 2008/0047407 | A1 | 2/2008 | Muller | |

FOREIGN PATENT DOCUMENTS

| | | | |
|---|---|---|---|
| DE | 2527620 | A1 | 1/1976 |
| DE | 8007660.4 | U | 12/1984 |
| DE | 3617349 | A1 | 11/1987 |
| DE | 4031671 | A1 | 5/1990 |
| DE | 3935320 | A1 | 6/1990 |
| DE | 4214264 | A1 | 1/1992 |
| DE | 4413568 | A1 | 10/1995 |
| DE | 4429046 | A1 | 2/1996 |
| DE | 19518597 | A1 | 11/1996 |
| DE | 19525742 | A1 | 1/1997 |
| DE | 19612055 | A1 | 10/1997 |
| DE | 19807693 | A1 | 8/1998 |
| DE | 19820058 | A1 | 12/1999 |
| DE | 10143508 | A1 | 5/2001 |
| DE | 10001338 | A1 | 8/2001 |
| DE | 10030691 | A1 | 1/2002 |
| DE | 20120688 | U1 | 2/2002 |
| DE | 10108018 | A1 | 9/2002 |
| DE | 10141713 | A1 | 3/2003 |
| DE | 10148595 | A1 | 4/2003 |
| DE | 10327249 | A1 | 1/2005 |
| DE | 10333661 | A1 | 2/2005 |
| DE | 10333661 | A1 | 5/2005 |
| DE | 10353114 | A1 | 5/2005 |
| DE | 1035521 | A1 | 6/2005 |
| DE | 10359149 | A1 | 7/2005 |
| DE | 102004006120 | A1 | 8/2005 |
| DE | 102004032829 | A1 | 2/2006 |
| DE | 102004033568 | A1 | 2/2006 |
| DE | 102005010184 | A1 | 9/2006 |
| DE | 102006062336 | B3 | 2/2008 |
| EP | 0107056 | A2 | 5/1984 |
| EP | 0158243 | A2 | 10/1985 |
| EP | 0413845 | A1 | 2/1991 |
| EP | 0867263 | A2 | 9/1998 |
| EP | 0930137 | A2 | 7/1999 |
| EP | 1040459 | B1 | 10/2000 |
| EP | 1046476 | A2 | 10/2000 |
| EP | 1820614 | A1 | 8/2007 |
| FR | 2677573 | A1 | 12/1992 |
| GB | 307126 | A | 3/1929 |
| GB | 324252 | A | 1/1930 |
| GB | 496562 | A | 11/1983 |
| GB | 2377362 | A | 1/2003 |
| GB | 2386317 | A | 9/2003 |
| JP | 11239995 | A | 7/1999 |
| JP | 2001021453 | A | 1/2001 |
| JP | 2006077945 | A | 3/2006 |
| WO | 00/59689 | A1 | 12/2000 |
| WO | 0179388 | A2 | 10/2001 |
| WO | 03/031126 | A2 | 4/2003 |
| WO | 2005/087456 | A1 | 9/2005 |
| WO | 2009/143969 | A2 | 12/2009 |

OTHER PUBLICATIONS

International Search Report Application No. (PCT/EP2009/002828) dated Apr. 17, 2009, published as WO2009/143939A3 on Mar. 12, 2009.

Preliminary Report on Patentability, Dated Nov. 9, 2010, Serial No. PCT/EP2009/002828.

Copending application, U.S. Appl. No. 11/836,329, filed Aug. 9, 2007, published as 2008/0047407.

Copending application, U.S. Appl. No. 10/565,874, filed Jul. 27, 2006 published as 2007/0028742.

Copending application, U.S. Appl. No. 10/576,233, filed Jan. 12, 2007 published as 2007/0214969.

Copending application, U.S. Appl. No. 10/552,514, filed Aug. 14, 2006, Patented as U.S. Pat. No. 7,614,574.

Opposition Document for EP2279064, filed with EPO on Jan. 9, 2013.

Additional Opposition Documents filed with EPO on May 28, 2014.

* cited by examiner

METHOD, DEVICE AND MEASURING DEVICE FOR CUTTING OPEN FOODSTUFF

The present invention relates to a method for cutting off food slices from at least one food bar using a rotating blade, in which the food bar can be transported with at least one transport means in the direction of the blade. Furthermore, the present invention relates to a device for cutting off food slices from at least one food bar using a rotating blade, in which the food bar can be transported with at least one transport means in the direction of the blade, and to a blade for slicing food.

The method of the type in question, the device and the blade are known from high-power slicing machines, as described, for example, in DE 100 01 338, EP 0 107 056, EP 0 867 263 and GB 2 386 317. In said what are referred to as "slicers", rod-shaped or differently shaped food, for example sausage, cheese, ham or the like, is cut into slices at a very high cutting power. For example, the food rod is transported here by means of a regulated drive through a positionally fixed cutting plane, in which cutting takes place by means of a rapidly moving, generally rotating blade. The slice thickness arises from the distance advanced by the food bar between two cuts. Accordingly, at a constant blade speed, the slice thickness is regulated via the advancing speed of the food bar. The cut slices are combined, generally with a constant number of slices, to form portions and are packaged. The methods and the devices according to the prior art have the disadvantage, however, that problems occur entirely unexpectedly or that changes to the product cannot be adequately reacted to.

It was therefore the object of the present invention to provide a method and a device which do not have the disadvantages of the prior art.

The object is achieved with a method for slicing a food bar using a device which has a rotating blade and at least one transport means, in which the food bar is placed into an advancing line and is transported by the transport means in the direction of the blade and, in the process, is sliced, wherein the device is assigned at least one vibration sensor and/or at least one product sensor which determines at least one parameter of the food bar, and the signal from which is used for monitoring and/or adjusting the device or the slicing operation.

In the method according to the invention, rod-shaped or differently shaped food, for example sausage, cheese, ham or the like, is cut into slices at a very high cutting power. For example, the food rod is transported here by means of a regulated drive through a positionally fixed cutting plane, in which cutting takes place by means of a rapidly moving, generally rotating blade. The slice thickness arises from the distance advanced by the food bar between two cuts. Accordingly, at a constant blade speed, the slice thickness is regulated via the advancing speed of the food bar. The cut slices are combined, generally with a constant number of slices, to form portions and are packaged. For the division into portions, preferably the blade is moved out of the cutting plane and/or the food to be sliced is drawn back.

Furthermore, according to the invention, the device is assigned at least one vibration sensor and/or at least one product sensor which determines at least one parameter of the food bar and the signal from which is used for monitoring and/or adjusting the device or the slicing operation.

The vibration sensor is arranged either directly on the device and therefore directly absorbs the vibrations therefrom, and/or it is arranged in the vicinity and absorbs vibrations from the air excited by the device. Accordingly, the vibration sensor may be, for example, a piezosensor or a microphone.

Furthermore, according to the invention, at least one parameter is determined with a product sensor. The product sensor may be a camera which can pick up waves of light visible to the human eye, ultraviolet radiation and/or infrared radiation. Using said camera, it can firstly be established what type of food product is involved and/or secondly what temperature said food product has. However, the sensor may also be a simple temperature sensor. Furthermore, the sensor may be a sensor which picks up mechanical properties of the product. The sensor may be arranged in the entry region, in the slicing region and downstream of the blade. Measurement downstream of the blade has the advantage that values, for example the temperature or mechanical values in the core of the product to be sliced, can also be determined.

The signal from the vibration sensor and/or from the product sensor is passed on to an evaluation unit which evaluates the signal therefrom.

For example, said signal can be used to determine the wear of parts, for example a bearing and other moving parts. On the basis of this analysis, a proactive service concept can be established, in which, for example, as favorable a maintenance date as possible is set and/or the required parts are ordered online.

Furthermore, the vibration sensor can be used to adjust the cutting gap. The cutting gap is the gap between the blade and a cutting strip. The size of said gap can be changed by adjustment of the blade and/or of the cutting edge. In principle, for an optimum cutting result, the cutting gap should be as small as possible, and the blade, during rotation thereof, should not touch the cutting strip. The blade and/or the cutting strip can now be moved toward each other until they touch or virtually touch, as a result of which the vibrations measured by the sensor change. The evaluation unit then knows that the cutting gap is very small or is too small. The gap is then preferably enlarged again by a predetermined amount. This adjustment of the cutting gap is carried out preferably under operating conditions, at the selected cutting power. Said adjustment preferably takes place after the blade for producing an unproductive cut has been moved away and back again from the cutting strip. By means of the magnitude of the rotational speed of the blade, by means of temperature influences, by means of the type of food to be sliced and/or by means of wear, the shape of the blade and therefore the size of the cutting gap during the slicing operation change. With the signal from the vibration sensor, it is possible to check said cutting gap during the slicing of a food and, if appropriate, to readjust said cutting gap, and to repeat said adjustment as often as desired without the cutting operation having to be interrupted.

Preferably, furthermore, the degree of bluntness of the blade is determined with the vibration sensor. Depending on the degree of sharpness of the blade, the vibration behavior of the slicing device and/or the noise produced when cutting the food products change/changes. For example, by means of a comparison with stored vibration profiles, the evaluation device can determine how sharp the blade still is and the service life it has left before it has to be replaced, and can thereby preferably establish a proactive blade-changing strategy. The downtime during the replacement is reduced as a result.

In a further preferred embodiment of the method according to the invention, at least one machine parameter is adjusted as a function of the signal from the product sensor. For example, the product sensor determines the type of product and/or the temperature thereof. On the basis of these measurements, for example, the rotational speed of the blade, the advancing speed of the food bar, the cutting gap, the movement of the delivery tray, the axial movement of the blade or of the rotor for producing an unproductive cut, the product position transversely with respect to the advancing direction and/or the X-Y alignment of the cutting head are/is adjusted. The measurement and the adjustment take place preferably automatically such that operating errors are at least reduced. For example, in the case of frozen products, the rotational speed of the blade can be reduced in order to prevent the cut-off products having an undesirable trajectory.

The cut-off food slices generally fall onto a delivery tray on which corresponding portions are formed. By means of defined movements of said delivery tray, differently designed portions can be produced, for example shingled portions. The movement of said tray can now be controlled as a function of the signal from a sensor, since the delivery site changes as a function of, for example, product parameters, such as temperature.

A plurality of food bars are preferably sliced simultaneously.

The object set above is also achieved by a device for cutting off food slices from at least one food bar using a rotating blade, in which the food bar can be transported with at least one transport means in the direction of the blade, characterized in that said device is assigned at least one vibration sensor and/or at least one product sensor.

The disclosure made with regard to the method according to the invention applies equally to the device according to the invention.

A further object of the device was to provide a device for cutting off food slices from at least one food bar, which device is as hygienic as possible and is easy to operate.

This object is achieved by a device for cutting off food slices from at least one food bar using a rotating, nonrotationally symmetrical blade, in which the food bar can be transported with at least one transport means in the direction of the blade, and the asymmetry of the blade is compensated for by a counter-weight, and the counterweight is arranged in the shaft driving the blade and/or in the blade holder.

A counterweight is required for the rotating operation of a nonrotationally symmetrical blade. According to the invention, said counterweight is now not arranged on the blade itself, as in the prior art, but rather in the shaft driving the blade and/or on the blade holder, the blade holder being the preferred location for the arrangement of the counterweight.

A blade holder is that part of the slicing machine on which the blade is mounted, and which rotates. The blade holder may be a part of the shaft, preferably a part which is telescopic, i.e. which is displaceable relative to the rest of the shaft. However, the blade holder may also be driven directly and is therefore also the shaft.

The device according to the invention is very hygienic because the counterweight can no longer become dirty. The counterweight does not have to be removed when changing the blade.

A further object of the present invention was to simplify the operability of a slicing machine and to reduce the blade-changing time.

This object is achieved by a method for changing a rotating, nonrotationally symmetrical blade of a device for slicing food bars, which device has a counterweight for the blade, wherein, when changing the blade, only the blade and not the counterweight is removed.

During the inventive process, a rotating blade which is, however, not rotationally symmetrical has to be replaced at regular intervals. In the case of a blade of this type, a counterweight is required for correct operation of the slicing device in order to obtain tolerable vibrations during the rotation of the blade. According to the invention, only the blade itself and not this counterweight is removed when changing the blade, thus simplifying the blade-changing operation.

Another object of the invention was to provide a blade for slicing food bars, which blade is as suitable as possible for displacement of the blade in order to produce an unproductive cut.

This object is achieved by a blade for slicing food, with a blade edge and a recess, in which at least one dimension of the recess is at least 140 mm and at most 450.

According to the invention, the blade has a recess in which at least one dimension is at least 140 mm and at most 450. The recess is preferably a circle, the diameter of which is between 140 and 450 mm. The size of the dimension, preferably the diameter of the recess, is preferably at least 200 and at most 435 mm, particularly preferably 240-360 mm. Said recess serves preferably for the mounting and/or centering of the blade on the device.

The radius of the blade edge is preferably between 250 and 550 mm. The blade is particularly preferably a spiral blade, and therefore the radius changes with the running length of the blade edge. The radius is preferably measured from the center of the recess.

The blade is connected to the slicing device by connecting means. Said means are preferably located outside the recess.

The weight of the blade including a mount, with which the blade can be suspended for connection to the device, is preferably at most 23 kg.

The ratio of the radius of the blade edge to the largest dimension of the recess at every point is preferably $<2.0$, preferably $<1.7$, particularly preferably $<1.5$ and most preferably $<1.3$. Said value is preferably always $>0.5$, particularly preferably $>0.55$ and very particularly preferably $>0.58$.

The invention is explained below with reference to the figures. These explanations are merely by way of example and do not restrict the general inventive concept. The explanations apply equally to ail of the subjects of the invention.

Figure 1:
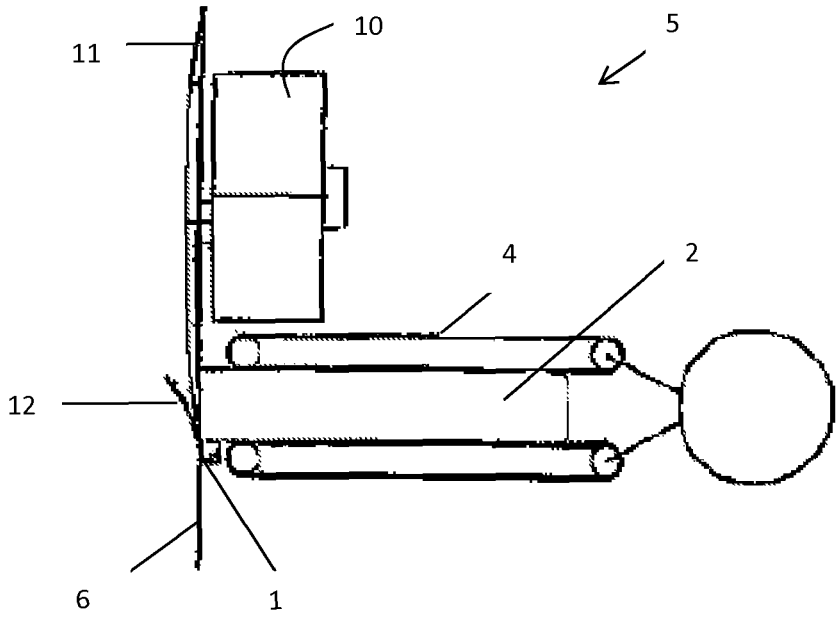
FIGS. 1, 2 show the slicing device according to the invention.
Figure 2:
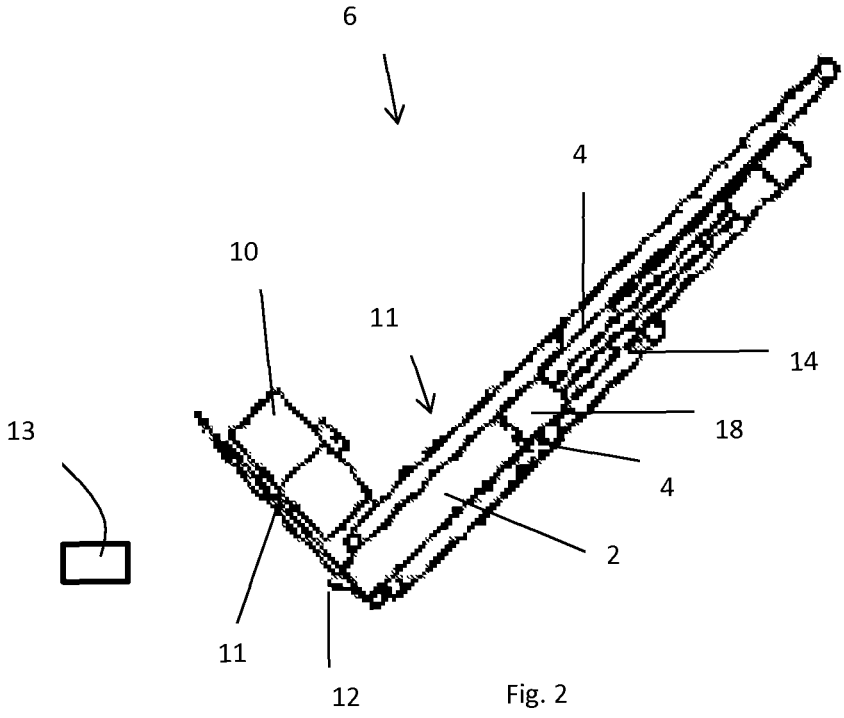

FIGS. 1 and 2 show a slicing machine according to the invention. The slicing machine 5 has a blade 11 which cuts a food bar 2 into food slices 12. The blade 11 rotates about a blade head 10. The sliced food slices 12 are generally arranged into portions on a delivery tray (not illustrated) and then packed. A person skilled in the art will recognize that a plurality of food bars can be sliced simultaneously. The food bars 2 are transported by two conveyor belts 4 continuously or discontinuously along the product line in the direction of the cutting plane 6, which is defined by the blade 11 and the cutting strip 1. During the cutting operation, the blade 11 and the cutting strip 1 interact. There must always be a cutting gap between the blade 11 and the cutting strip 1 in order to prevent the blade from touching the cutting strip. However, said cutting gap should be as small as possible in order to prevent "tearing off" of the particular slice and/or the "formation of beards". The slice thickness is produced from the distance advanced by the food bar between two cuts. At a constant blade speed, the slice thickness is regulated via the advancing speed of the food bar. The conveyor belts 4 are open on the inlet side. In the case of high-power slicers, in particular in order to form portions, unproductive cuts, in which the blade rotates without coming into engagement with the product, have to be carried out. This takes place preferably by the blade 11 being moved away from the cutting plane 6 and from the product 2. As soon as a sufficient number of unproductive outs have been carried out, the blade is moved back in the direction of the cutting strip 1. As can be gathered in particular from FIG. 2, the food bar is brought at the rear end 17 thereof into contact with a gripper 18. Furthermore, FIG. 2 illustrates a product sensor 13, here a camera, the function of which is explained further below.

The device 5 according to the invention has at least one vibration sensor 25 and/or at least one product sensor 13 which determines at least one parameter of the food bar. The signal from at least one of these sensors is used for monitoring and/or adjusting the device or the slicing operation.

The vibration sensor is arranged either directly on the device and therefore directly absorbs the vibrations therefrom and/or it is arranged in the vicinity and absorbs vibrations from the air excited by the device. Accordingly, the vibration sensor may be, for example, a piezosensor or a microphone.

The vibration sensor measures the frequency and the amplitude of the vibrations which occur.

At least one parameter is determined by the product sensor 13. The present case involves a camera which can pick up and process waves of the light visible to the human eye, ultraviolet radiation and/or infrared radiation. A person skilled in the art will understand that it may also be expedient, however, in certain applications to filter the wavelength of the observed light. Using said camera, it can firstly be established what type of food product is involved and/or secondly what temperature said food product has. The sensor may also be a sensor which picks up mechanical properties of the product. The sensor may be arranged in the input region, in the slicing region and downstream of the blade. In the illustration according to FIG. 2, the camera 13 is arranged in front of the blade and can determine, for example, the temperature in the core of the food bar. The camera can be directed toward the food bar 2 and/or toward the cut-off food slices 12.

The signal from the vibration sensor and/or from the product sensor is passed on to an evaluation unit which evaluates the signal therefrom. An evaluation can take place, for example, by means of a comparison of the measured frequencies and amplitudes of the vibrations with stored values in order to determine changes. As a result, wear of parts, for example a bearing and other moving parts, can be determined.

Furthermore, the vibration sensor can be used for adjusting the cutting gap. The cutting gap is the gap between the blade 11 and a cutting strip 1. The size of said gap can be changed by adjustment of the blade 11 and/or of the cutting edge 1. In principle, for an optimum cutting result, the cutting gap should be as small as possible, and the blade, during the rotation thereof, should not touch the cutting strip. The blade and/or the cutting strip can now be moved toward each other, with the blade 11 rotating, until they touch or virtually touch, as a result of which the vibrations measured by the sensor change. In particular when the blade 11 and cutting strip 1 touch, there is generation of a noise which is measured by the vibration sensor. The evaluation unit then knows that the cutting gap is very small or is too small. The gap is preferably then enlarged again by a predetermined amount by the cutting strip and/or the blade being moved away from each other. This adjustment of the cutting gap is carried out preferably under operating conditions, at the selected cutting power (nominal rotational speed). Said adjustment preferably takes place after the blade for producing an unproductive cut has been moved away from the cutting strip 1 and back again. By means of the magnitude of the rotational speed of the blade, by means of temperature influences, by means of the type of food to be sliced and/or by means of wear, the shape of the blade and therefore the size of the cutting gap during the slicing operation change. With the signal from the vibration sensor, it is possible to check said cutting gap during the slicing of a food and, if appropriate, to readjust said cutting gap, and to repeat said adjustment as often as desired without the cutting operation having to be interrupted or the rotational speed of the blade reduced.

Preferably, furthermore, the degree of the bluntness of the blade is determined with the vibration sensors. Depending on the degree of sharpness of the blade, the vibration behavior of the slicing device and/or the noise produced during cutting of the food products change/changes. For example, by means of a comparison with stored vibration profiles, the evaluation device can determine how sharp the blade still is and the service life it still has left before it has to be replaced and, as a result, can preferably establish a proactive blade-changing strategy. As a result, the downtime during the replacement is reduced.

Furthermore, the adjustment of at least one machine parameter takes place as a function of the signal from the product sensor 13. For example, the product sensor determines the type of product and/or the temperature thereof. On the basis of this measurement, for example, the rotational speed of the blade 11, the advancing speed of the food bar 2, the cutting gap, the movement of the delivery tray and/or the X-Y alignment of the cutting head 10 are/is adjusted. The measurement and the adjustment take place preferably automatically, and therefore operating errors are at least reduced. For example, in the case of frozen products, the rotational speed of the blade can be reduced in order to prevent the cut-off products from having an undesirable trajectory.

Figure 3:
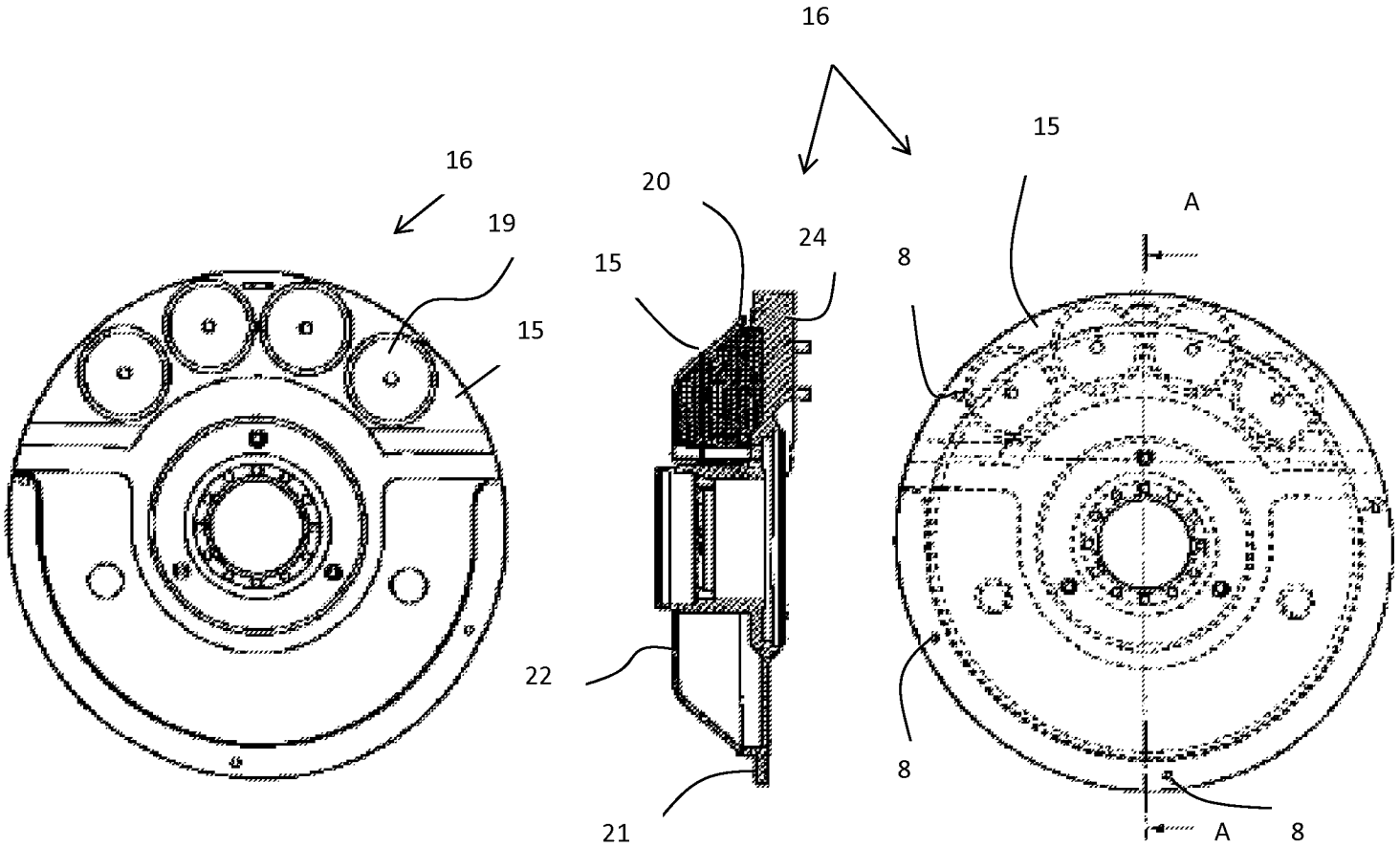
FIG. 3 shows the blade holder with the counter-weight.

FIG. 3 shows a blade holder 16 to which the blade 11 is fastened. The blade holder 16 is illustrated in three views, wherein the middle view illustrates a section along the line A-A shown in the right-hand illustration. The blade holder 16, which rotates together with a driveshaft (not illustrated), has a basic body 24 on which the bearing surface 21 and the centering surface 20 for the blade are arranged. The blade 11 is screwed onto the basic body 24 with the aid of the threaded bores 8. The threaded bores 8 are arranged in such a manner that the blade can be arranged only in a single position on the blade holder. Furthermore, the blade holder 16 has a counterweight 15 with which the asymmetry of the blade 11 to be fastened to the blade holder is compensated for. Said counterweight is located below a covering 22 and within the centering surface 20. When the blade 11 is fitted on the blade holder 16, the blade is moved over the compensating weight 15 and placed against the bearing surface 21 and the centering surface 20. Therefore, during fitting and removal, or removal of the blade, the counterweight 15 does not have to be fitted or removed. Recesses 19 in which additional weights can be arranged are located in the counterweight 15, which may be helpful in particular for fine balancing.

Figure 4:
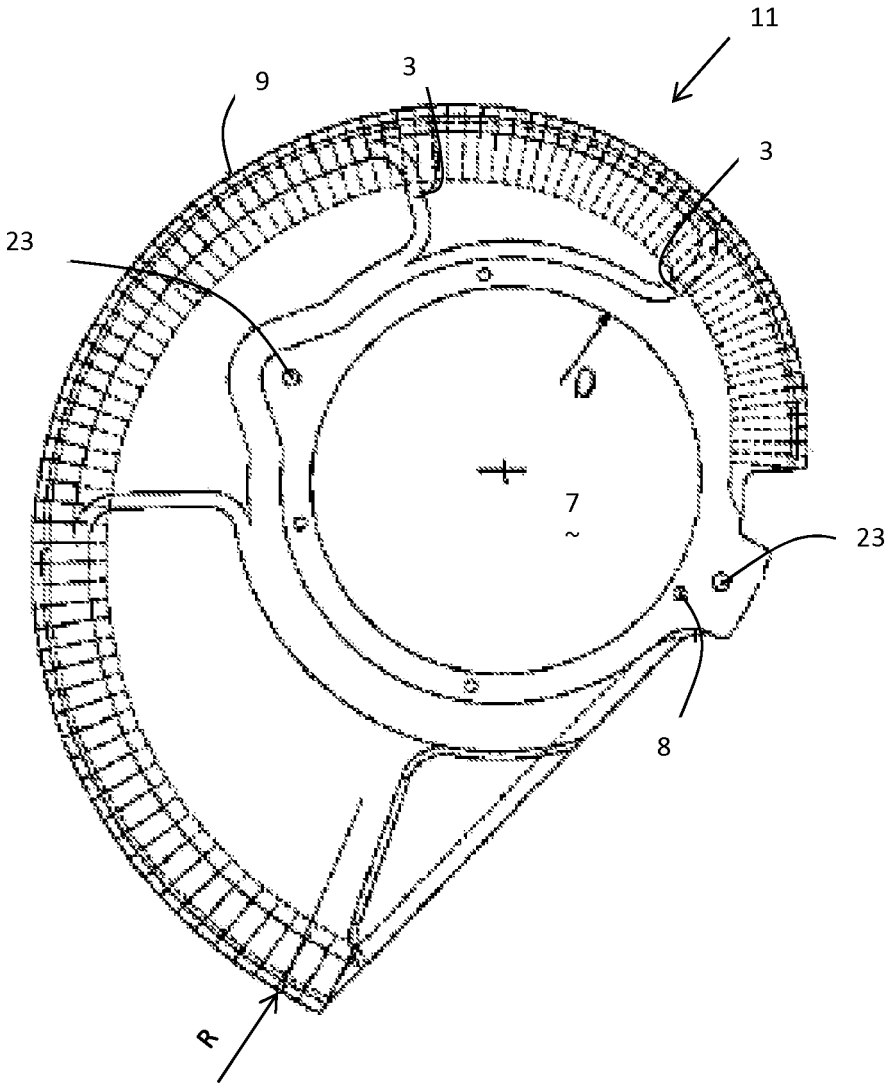
FIG. 4 shows the blade according to the invention.

FIG. 4 shows the blade according to the invention, a spiral blade in the present case. Said blade has a very large recess 7 which has a diameter D, in the present case 330 mm. The blade, on the outer radius thereof, has a blade edge 9 which has a radius of 200 mm-465 mm, measured from the center point of the recess 7. The cutouts 3 reduce the friction between the product to be sliced and the blade. The blade is fastened to the blade holder by means of screws which are screwed into the thread 8 of the blade holder through bores 8 in the blade. The bores are arranged along the diameter of the recess 7 in such a manner that the blade can be fastened only in a single position relative to the blade head, and therefore the blade is located in particular in the correct position relative to the blade head. The recesses 23 enable the blade to be held during the fastening thereof to the blade holder. The blade has a very low weight for the size thereof (cutting radius at most 500 mm), the weight including the blade mount being less than 23 kilograms. This has a positive effect on the handling of the blade but also on the forces which occur when the blade is transferred out of the cutting plane.

LIST OF DESIGNATIONS

1 Cutting edge, cutting strip
2 Food bar
3 Cutout
4 Transport means, traction belt
5 Slicing device
6 Cutting plane
7 Recess
8 Fastening means
9 Blade edge
10 Cutting head
11 Blade
12 Food slice
13 Product sensor
14 Product line
15 Counterweight
16 Blade holder
17 End of the product bar facing away from the blade
18 Gripper
19 Balancing weight
20 Centering surface
21 Bearing surface
22 Covering
23 Recess
24 Basic body
25 Vibration sensor
D Dimension, length, diameter of the recess 7
R Radius of the blade edge

The invention claimed is:

1. A mount and blade for slicing food comprising:
i. a blade having:
a blade edge,
a circular aperture having a center point, and
a plurality of bores,
ii. a mount;
wherein a diameter of the circular aperture, D, is at least 240 mm and at most 360 mm;
wherein the blade edge has a radius, R, measured from the center point of the circular aperture to the blade edge,
wherein R is between 250 and 550 mm;
wherein the blade including the mount has a weight that is at most 23 kg;
wherein the ratio of R/D is less than 2.0 for every point on the blade edge,
wherein the bores are asymmetrically arranged around the circular aperture so that the blade can be mounted on the mount in only a single position, and
wherein the blade edge is rotationally non-symmetrical and extends less than about three quarters around a circumference of the circular aperture.

2. The mount and blade as claimed in claim 1, wherein a counterweight is not arranged on the blade itself.

3. The mount and blade as claimed in claim 1, wherein the ratio R/D is less than 1.3 for every point on the blade edge; and the ratio R/D is greater than 0.5 for every point on the blade edge.

4. The blade as claimed in claim 1, wherein an overall surface area of the blade is substantially planar when mounted on the slicing device.

5. A blade for slicing food comprising:
a blade edge,
a circular aperture having a circumference for mounting and centering the blade on a slicing device,
a plurality of recesses arranged around the aperture,
a plurality of bores arranged around the aperture,
one or more asymmetrical cutouts arranged around the aperture,
at least one dimension, D, of the aperture is a diameter of the aperture and is at least 140 mm and at most 450 mm, and
the blade edge has a radius, R, measured from the blade edge to a center point of the aperture, wherein the ratio of R/D is less than 2.0 for every point on the blade edge, and
wherein the blade edge extends around a portion of the circumference of the circular aperture not to exceed about three-quarters of the circumference,
wherein the recesses enable the blade to be held during fastening to the slicing device.

6. The blade as claimed in claim 5, wherein an overall surface area of the blade is substantially planar when mounted on the slicing device.

7. The blade as claimed in claim 5, wherein the ratio R/D is less than 1.5 for every point on the blade edge.

* * * * *